US006834754B2

(12) United States Patent
Pietz

(10) Patent No.: US 6,834,754 B2
(45) Date of Patent: Dec. 28, 2004

(54) METHOD FOR GUIDING A LINK PLATE CHAIN IN AN AREA OF A REVERSING DEVICE OF A PEDESTRIAN CONVEYOR SYSTEM

(75) Inventor: Alexander Pietz, Berlin (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/771,233

(22) Filed: Feb. 4, 2004

(65) Prior Publication Data

US 2004/0168891 A1 Sep. 2, 2004

Related U.S. Application Data

(63) Continuation of application No. PCT/EP02/07811, filed on Jul. 13, 2002.

(30) Foreign Application Priority Data

Aug. 4, 2001 (DE) ..... 101 38 462

(51) Int. Cl.[7] ..... B66B 21/00
(52) U.S. Cl. ..... 198/330; 198/834
(58) Field of Search ..... 198/321, 330, 198/323, 834, 835

(56) References Cited

U.S. PATENT DOCUMENTS 2,906,390 A * 9/1959 Hefti ..... 198/330
5,697,486 A 12/1997 Krampl
5,755,315 A * 5/1998 Wallbaum et al. ..... 198/331
5,775,477 A 7/1998 Brunn
5,791,455 A * 8/1998 Clopton ..... 198/834
5,819,910 A 10/1998 Langer et al.
6,412,625 B2 * 7/2002 Damkjaer ..... 198/834
6,540,060 B1 * 4/2003 Fargo et al. ..... 198/330
6,637,579 B2 * 10/2003 Pietz ..... 198/322

FOREIGN PATENT DOCUMENTS

| | | |
|---|---|---|
| DE | 17 22 177 | 3/1956 |
| DE | 1 756 813 | 7/1968 |
| DE | 198 49 236 | 2/2000 |
| DE | 199 41 913 | 3/2001 |
| EP | 0 711 725 A1 | 10/1995 |

* cited by examiner

*Primary Examiner*—James R. Bidwell
(74) *Attorney, Agent, or Firm*—Venable LLP; Robert Kinberg

(57) ABSTRACT

A method and arrangement are provided for guiding a drive chain in an area of a reversing chain wheel of a pedestrian conveyor system. The drive chain contains plate link elements, connecting elements connecting the plate link elements in leading and trailing coupling areas of the respective plate link elements, and guide rolls respectively located in the spaces between the coupling areas. The arrangement is such that the drive chain is guided into the chain wheel so that, as seen in the direction of movement, the connecting element in a leading coupling area of one plate link element is guided into an associated reception area of the chain wheel. The guiding roll of that plate link element is then brought into a corresponding cap-shaped indentation of the reversing wheel. The connecting element of the trailing coupling area of same plate link element is guided into an associated reception area of the reversing wheel after the guiding roll of that plate link element is supported by the cap-shaped indentation in an elastically cushioned manner. The guiding roll of a subsequent plate link element, as seen in the direction of movement, is supported on a guiding profile until the connecting element in the trailing coupling area of the preceding plate link element is introduced into the associated reception area.

6 Claims, 1 Drawing Sheet

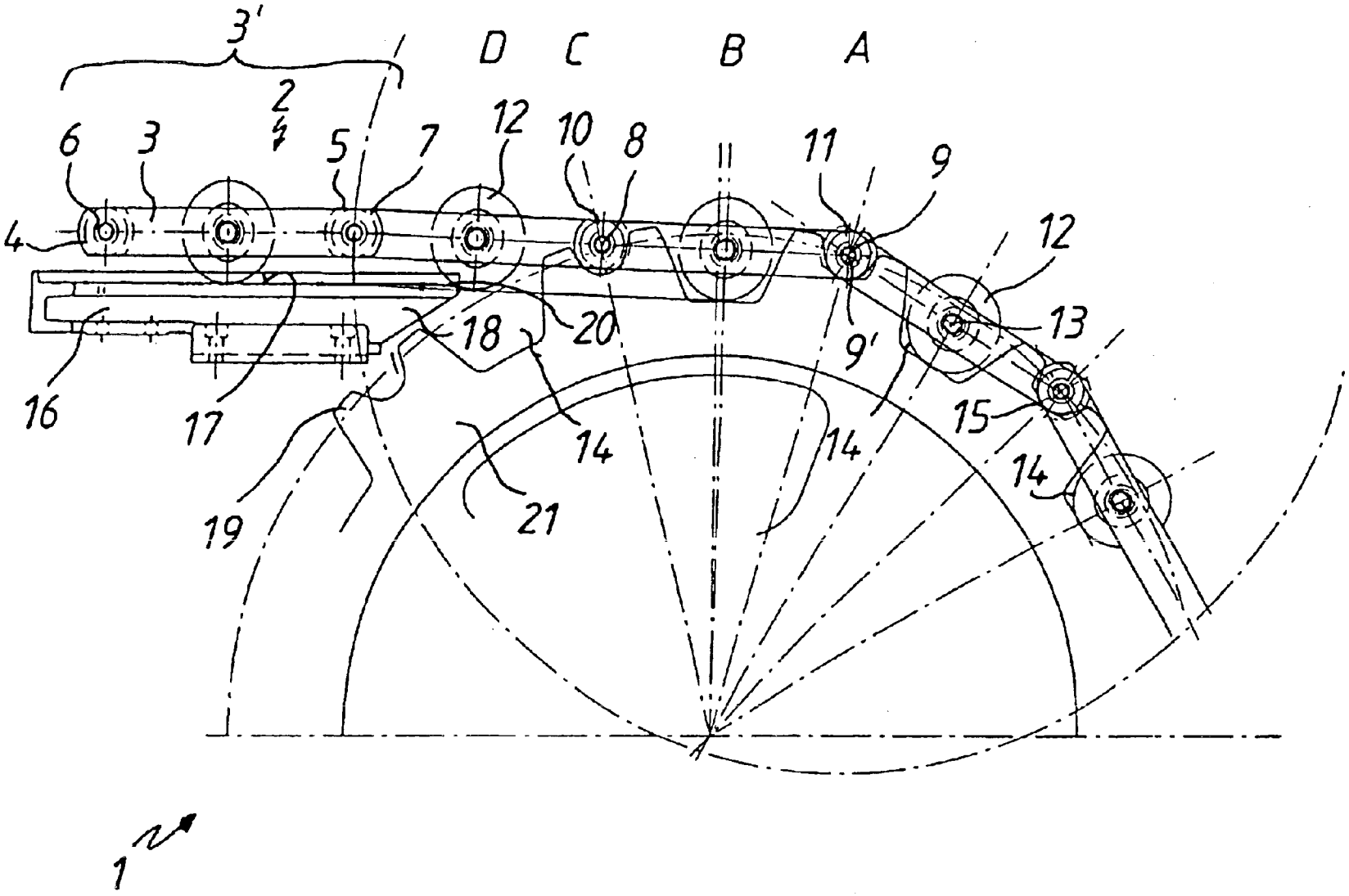
A
B
C
D
1
2
3
3'
4
5
6
7
8
9
9'
10
11
12
13
14
15
16
17
18
19
20
21

METHOD FOR GUIDING A LINK PLATE CHAIN IN AN AREA OF A REVERSING DEVICE OF A PEDESTRIAN CONVEYOR SYSTEM

CROSS-REFERENCE TO RELATED APPLICATIONS

The present application is a continuation of International Application No. PCT/EP02/07811, filed on Jul. 13, 2002, designating the United States and claiming priority with respect to German Application No. 101 38 462.9, filed Aug. 4, 2001, to which the present application also claims priority. Each of the foregoing applications is incorporated herein by reference.

BACKGROUND OF THE INVENTION

The invention relates to a method for guiding a drive chain, comprising link plates, guiding rolls and connecting elements, in the area of a reversing device, which is formed by a chain wheel, of a pedestrian conveyor system, such as an escalator or moving walkway.

In the reversing of a drive chain of pedestrian conveyor system by means of a reversing device comprising a chain wheel, undesired polygon and revolution effects occur which in particular adversely affect the quiet running of the pedestrian conveyor system. The polygon effect is caused by the polygonal resting of the chain on the chain wheel. With increasing rotation angle, the effective radius of the chain wheel varies, whereby the velocity of the chain oscillates between a maximum and a minimum value. When engaging the chain wheel, the chain rolls and the teeth of the chain wheel have different velocities, which cause impacts. The revolution effect is caused by the angular momentum which is transmitted from the chain wheel onto the chain links and thus onto the steps or pallets of an escalator or moving walkway. In the past, there have been various attempts at reducing the problem of the polygon effect during the reversing of the drive chain around the chain wheel.

European Patent Application No. EP-A 0 711 725 (corresponding to U.S. Pat. No. 5,697,486) describes an arrangement for guiding a band continuum for driving escalators or moving walkways, composed of steps or pallets. The arrangement includes chain links connected to adjacent chain links by means of chain studs, and chain rolls retained by the chain studs, wherein the chain rolls are guided on a running path of a supporting rail and on a running path of an equalizing rail, and are reversed by a chain wheel. The running path of the supporting rail and the running path of the equalizing rail are placed at a chain wheel circle of the chain wheel outside a tangent extending in the direction of movement of the band continuum, wherein one end of the running path of the equalizing rail is guided towards the chain wheel circle. Herein, the chain comprises chain rolls provided in the end regions of the link plates.

German Patent document DE-A 198 49 236 discloses a method and a device for guiding a chain in the area of a chain wheel of a continuous conveyor system, by supplying the chain to the respective chain or driving wheel in a linear direction, wherein after engagement of a first element of a first chain link of the chain strand with the chain or driving wheel, a continuous adaptation of the effective chain radius is realized, while setting a constant velocity in the chain strand. Alternatively, it is proposed to supply the chain to the respective chain or driving wheel in a linear direction and first to bring a first element of a first chain link of the chain strand into engagement with the chain or driving wheel, wherein the reversing of the first chain link by means of the chain wheel is only carried out after a second element of the first chain link has been positioned by engagement with the chain wheel and wherein the other chain links of the chain strand are guided into the chain wheel and reversed in the same way. Herein, the chain rolls can, as previously described, be provided in the coupling area of single link plates and guided between the same ones, or they can be positioned outside the link plates.

German Patent document DE-A 17 56 813 discloses a roller-step chain connection of escalators, in which the step bolt is located between two joints of the drive chain of an escalator. The rollers can be provided between two joints of the drive chain inside or outside the inner link plates or outer link plates. If enlargements of the chain pitch are desired, such a solution also requires changes at the chain wheel. Without these measures, the generated polygon and revolution effects cannot be controlled.

German Utility Model 17 22 177 describes a conveyor, such as a drag bar feeder, steel plate apron conveyer or the like, containing chains, like round link chains or plate link chains, moving the conveyor. An essential disadvantage of the this type of conveyor, namely the sagging of the chains in the lower track area by continuous lengthening of the chains during operation, will be eliminated. The chains are brought into the lower part of the chain wheel. In this area, in front of the chain wheel, guiding channels for the chains are positioned, increasing and then inclining tangentially in direction of the chain wheel.

U.S. Pat. No. 5,775,477 shows a drive system for a curved escalator containing plate link chains, the inner and outer plates of the plate links are connected by bolts wherein the bolts are surrounded by liners in the area of the inner plates, and wherein between the liners and the bolts a spherical bearing is situated. A part of a wheel shaft is placed in the region of the pallets, extending into the region of the plate link chain, and a track roller is situated between parallel inner plates. The part of the wheel shaft first extends through the pallet near the inner plate, then through the roller and is fixed within the wall of the opposite plate, for example by a spring ring. Outside the end of the part of the wheel shaft, in the area of the corresponding inner plate, a carrying element is removably connected. The carrying element is used to seat upper and lower guiding rollers, which contain by analogy to the bolts of the end section of the plates, a spherical bearing.

SUMMARY OF THE INVENTION

It is an object of the invention to provide a method and a device, by means of which the above described polygon and revolution effects can be efficiently reduced, so that the quiet running of the pedestrian conveyor system, such as in particular an escalator or moving walkway, can be improved.

The above and other objects are achieved according to the invention by the provision of A method for guiding a drive chain of a pedestrian conveyor system in an area of a reversing device, the reversing device comprising a chain wheel having reception areas separated by respective cap-shaped indentations, the drive chain being comprised plate link elements, each plate link element having leading and trailing coupling areas with respect to a direction of movement of the drive chain, and connecting elements located in the coupling areas for connecting a leading coupling area of one plate link element to a trailing coupling area of a subsequent plate link element as viewed in the direction of movement, the drive chain further including respective guiding rolls each being positioned in a space between the coupling areas of the plate link elements and being supported on a guiding profile at least on a side of the chain wheel, the method comprising: guiding the drive chain into the chain wheel so that, as seen in the direction of movement, the connecting element in a leading coupling area of one plate link element is guided into an associated reception area of the chain wheel; bringing the guiding roll of the one plate link element into a corresponding cap-shaped indentation of the chain wheel; guiding the connecting element of the trailing coupling area of the one plate link element into an associated reception area after the guiding roll of the one plate link element is supported by the cap-shaped indentation in an elastically cushioned manner; and supporting the guiding roll of a subsequent plate link element, as seen in the direction of movement, on the guiding profile until the connecting element in the trailing coupling area of the one plate link element is introduced into the associated reception area.

Thus, according to the method of the invention, the connecting element will not be brought into the reception area before the guiding roll is supported elastically cushioned within the corresponding spherical cap, and the guiding roll of the following plate link element, seen in the direction of movement, is supported on the guiding profile, until the connecting element of the forward positioned plate link element is placed within the corresponding reception area.

According to another aspect of the invention, there is provided an arrangement for guiding a drive chain in a direction of movement toward a reversing device in a pedestrian conveyor system, comprising: a reversing device comprising a chain wheel including receptions areas and respective cap-shaped indentations between the reception areas; a drive chain comprising plate link elements, the plate link elements each having leading and trailing coupling areas with respect to the direction of movement of the drive chain, and connecting elements located in the coupling areas for connecting the trailing coupling area of one plate link element to a leading coupling area of subsequent plate link element with respect to the direction of movement, the drive chain further including guiding rolls each being positioned in a space between the coupling areas of the respective plates link elements; and a guiding profile at least on a side of the chain wheel for supporting the guiding rolls; wherein the chain wheel, drive chain and guiding profile are arranged so that, as seen in the direction of movement, a connecting element of a leading coupling area of one plate link element is first brought into a corresponding reception area of the chain wheel before the guiding roll of the one plate link element leaves the guiding profile, and the guiding roll of the one plate link element is positioned elastically cushioned within an associated cap-shaped indentation of the chain wheel before the connecting element of the trailing coupling area of the one plate link element is positioned within the associated reception area.

Thus, according to the arrangement of the invention the guiding profile is positioned so far into the direction of the chain wheel, that seen in the direction of movement, the connecting element of a leading plate link element is positioned in an associated reception area, before the guiding roll leaves the guiding profile, and the guiding roll is positioned elastically cushioned within the associated spherical cap, before the following connecting element is positioned within the associated reception area.

In contrast to the state of the art, the method and the device according to the invention assure that, for drive chains, as they are generally described in German Patent document DE-A 17 56 813, no or only negligible polygon effects are generated during inserting: and reversing the drive chain in the area of the chain wheel. This is due to the fact that, on the one hand, the subsequent guiding roll, seen in the direction of movement, remains supported by the guiding profile as long as the preceding guiding roll is placed in the cap-shaped indentation in an elastically cushioned manner, and on the other hand, the connecting element, which forms the end portion of the preceding link plate, and the initial portion of the subsequent link plate, is supported in the associated reception area. There is therefore no more chain sagging, which would also lead to impacts, when the respective connecting element is guided into the associated reception area. By means of the chosen technical adaptations at the chain as well as the chain wheel: with respect to the given different velocities of chain and chain wheel, the object of the invention leads to excellent running properties entailing a reduction of the polygon effect. Thus, the drive chain can be guided horizontally into the area of the chain wheel in a simple manner. Complex, if necessary, curve-like or tangentially provided guiding elements for the transport of the guiding rolls into the area of the chain wheel are as unnecessary as profiled running paths of equalizing rails or the like.

BRIEF DESCRIPTION OF THE DRAWINGS

FIG. 1 is a schematic showing a side view of an exemplary embodiment of the invention.

DETAILED DESCRIPTION OF THE INVENTION

Referring to FIG. 1, there is shown a reversing area 1 for a link plate chain 2. Link plate chain 2 includes single link plates 3, which are guided in parallel, and which are in active relation with each other in their coupling areas 4, 5 via connecting elements 6, 7, to form link plate elements 3'. The connecting elements 6, 7 are formed by studs 8, 9 as well as guide bushes 10, 11. Between the coupling areas 4, 5 of the single parallel link plates 3, respective guiding rolls 12 are provided approximately at half-height of the link plates 3, which can be rotated around an axis 13. The link plate chain 2 is reversed in the reversing area 1 of, for example, an escalator or moving walkway, neither of which are shown, around a chain wheel 21 provided therein, if possible, without the known polygon and revolution effects. The chain wheel 21 is provided with cap-shaped indentations 14 for receiving the guiding rolls 12. Reception areas 15 for receiving and guiding the connecting elements 6, 7, and respective bushes are provided between the cap-shaped indentations 14. The direction of movement of the link plate chain 2 is indicated by an arrow 25, and the direction of movement of the chain wheel 21 is indicated by arrow 26. In front of the chain wheel 21, a guiding profile 16 is positioned, which is arranged, such that a horizontal running of the link plate chain 2 into the area of chain wheel 21 is assured. On the side of the chain wheel, the guiding profile 16 has a bevelled portion 18 outside the running path 17 for the guiding rolls 12, which enables the guiding profile 16 to be positioned at a predetermined small distance from the teeth 19 of chain wheel 21.

The invention operates according to the following steps. As seen in the direction movement of link plate chain 2, first one of the connecting elements 7, including a respective bush 11, is introduced into the associated reception area 15 of chain wheel 21 as shown at A. Each link plate element 3' is seen separately, but the method concerns the whole link chain 2. In the further course of the reversing, the guiding roll 12, which is provided at least on its running face with an elastically dampening profile (not shown) of predetermined Shore hardness, is guided into the associated cap-shaped indentation 14 as shown at B. Connecting element 6 adjacent thereto, including the respective bush 10, is only introduced into the associated reception area 15, as shown at C, when the preceding guiding roll 12 is supported elastically. For avoiding a possible sagging of the chain between the guiding profile 16 and the following cap-shaped indentation 14, the next guiding roll1 12 is guided on an end region 20 of the guiding profile as shown at D until the preceding bush 10 has been placed in the associated reception area 15 with little or no noise. Each link plate element 3' thus forms a lever arm of length A-C around the respective stud axis 9', as seen in the direction of movement.

As a result of the invention, polygon and revolution effects are efficiently reduce, whereby quiet running of the escalator or pedestrian walkway is considerably increased.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for guiding a drive chain of a pedestrian conveyor system in an area of a reversing device, the reversing device comprising a chain wheel having reception areas separated by respective cap-shaped indentations, the drive chain being comprised plate link elements, each plate link element having leading and trailing coupling areas with respect to a direction of movement of the drive chain, and connecting elements located in the coupling areas for connecting a leading coupling area of one plate link element to a trailing coupling area of a subsequent plate link element as viewed in the direction of movement, the drive chain further including respective guiding rolls each being positioned in a space between the coupling areas of the plate link elements and being supported on a guiding profile at least on a side of the chain wheel, the method comprising:

guiding the drive chain into the chain wheel so that, as seen in the direction of movement, the connecting element in a leading coupling area of one plate link element is guided into an associated reception area of the chain wheel;

bringing the guiding roll of the one plate link element into a corresponding cap-shaped indentation of the chain wheel;

guiding the connecting element of the trailing coupling area of the one plate link element into an associated reception area after the guiding roll of the one plate link element is supported by the cap-shaped indentation in an elastically cushioned manner; and supporting the guiding roll of a subsequent plate link element, as seen in the direction of movement, on the guiding profile until the connecting element in the trailing coupling area of the one plate link element is introduced into the associated reception area.

2. The method according to claim 1, including horizontally introducing the drive chain into the chain wheel.

3. An arrangement for guiding a drive chain in a direction of movement toward a reversing device in a pedestrian conveyor system, comprising:

a reversing device comprising a chain wheel including receptions areas and respective cap-shaped indentations between the reception areas;

a drive chain comprising plate link elements, the plate link elements each having leading and trailing coupling areas with respect to the direction of movement of the drive chain, and connecting elements located in the coupling areas for connecting the trailing coupling area of one plate link element to a leading coupling area of subsequent plate link element with respect to the direction of movement, the drive chain further including guiding rolls each being positioned in a space between the coupling areas of the respective plates link elements; and a guiding profile at least on a side of the chain wheel for supporting the guiding rolls;

wherein the chain wheel, drive chain and guiding profile are arranged so that, as seen in the direction of movement, a connecting element of a leading coupling area of one plate link element is first brought into a corresponding reception area of the chain wheel before the guiding roll of the one plate link element leaves the guiding profile, and the guiding roll of the one plate link element is positioned elastically cushioned within an associated cap-shaped indentation of the chain wheel before the connecting element of the trailing coupling area of the one plate link element is positioned within the associated reception area.

4. The arrangement according to claim 3, wherein the guiding profile has a tapering portion on a side of the chain wheel outside a running path of the guiding rolls.

5. The arrangement according to claim 3, wherein the guiding profile extends horizontally in a direction of the chain wheel at a relatively small distance from teeth of the chain wheel.

6. The device according to claim 3, wherein the guiding rolls are provided with an elastically damping profile of predetermined Shore hardness, at least on a side of a running face of the guide rolls.

* * * * *